United States Patent [19]

Starbuck

[11] Patent Number: 4,695,371

[45] **Date of Patent: * Sep. 22, 1987**

[54] NONAQUEOUS COAL CLEANING PROCESS

[76] Inventor: Arthur E. Starbuck, 1430 Kirston St., Reno, Nev. 89503

[ * ] Notice: The portion of the term of this patent subsequent to Jul. 22, 2003 has been disclaimed.

[21] Appl. No.: 634,751

[22] Filed: Jul. 26, 1984

[51] Int. Cl.[4] ..... B04C 5/14; B04C 9/00; F26B 3/00

[52] U.S. Cl. ..... 209/211; 209/5; 209/11; 209/172; 44/1 SR; 34/9

[58] Field of Search ..... 209/5, 3, 11, 211, 172; 44/1 SR; 34/9; 423/578 A, 578 R; 252/303; 241/24

[56] References Cited

U.S. PATENT DOCUMENTS

| | | | |
|---|---|---|---|
| 2,109,234 | 2/1938 | Keenan | 209/172 X |
| 2,829,771 | 4/1958 | Dahlstrom | 209/211 |
| 3,308,946 | 3/1967 | Mitzmager | 209/172 X |
| 3,552,031 | 1/1971 | Evans et al. | 34/9 |
| 3,607,143 | 9/1971 | Weirman | 423/578 A |
| 4,140,628 | 2/1979 | Horsfall | 209/211 X |
| 4,157,295 | 6/1979 | Liller | 209/5 |
| 4,198,289 | 4/1980 | Elliot et al. | 209/11 |
| 4,203,727 | 3/1980 | Simpson | 44/1 SR |
| 4,213,793 | 7/1980 | Starbuck | 423/578 A |
| 4,324,560 | 4/1982 | Fonseca | 209/172 X |
| 4,364,822 | 12/1982 | Rich, Jr. | 209/3 |
| 4,575,418 | 3/1986 | Robbins | 209/3 |

OTHER PUBLICATIONS

"Heavy Media Separation of SRC–II Feed Stocks" by Ajay Sood *Fuel Magazine* Jan/84, vol. 63, pp. 84–92.

"Cleaning of Fire Materials by Compound Water Cyclone" Canadian Mining and Metallurgical Bulletin for 3/66, Revised Paper Presented to C.I.M., Annual Meeting, Edmonton 4/63.

*Primary Examiner*—S. Leon Bashore
*Assistant Examiner*—Thomas M. Lithgow
*Attorney, Agent, or Firm*—Bielen & Peterson

[57] ABSTRACT

A process for coal cleaning providing a method of cycloning fine particle coal for cleaning the cola of ash and pyrites, the method including steps of demoisturizing the coal by immersing the coal in an elevated temperature, non-aqueous liquid and cycloning the coal in a non-aqueous, agglomerate inhibiting carrier liquid.

7 Claims, No Drawings

NONAQUEOUS COAL CLEANING PROCESS

BACKGROUND OF THE INVENTION

This invention relates to a new and improved method for refining coal, particularly coal containing sulfur.

Various methods have been proposed for removal of sulfur from coal. The methods are generally tailored to remove a particular form of sulfur which may be an elemental, pyritic, organic or sulfate form of sulfur. Because of the extremely complex composition of coal and the radical variance in composition from seam to seam, and even within a single seam, the problems in effectively removing substantially all sulfur and sulfur compounds are significant.

It is believed, that the goal of reducing sulfur emissions from the combustion of coal can best be achieved prior to pyrolysis using efficient refining methods. In this manner combustion systems can be designed to a maximized efficiency through fueling with a uniform, high Btu, low ash and low-sulfur feed stock. Use of efficient combustion systems and high grade refined coal will have a substantial impact on acid raid caused by sulfur dioxide emissions from coal-fired energy and processing plants.

It is a primary object of this invention to produce a moisture free, fine particle material that can be used, as is, in a blow-fired or fluidized bed combustor; formed into a briquette or slug, for a grate-type combustor; or, mixed in an slurry or emulsion for transport and firing in a liquid spray as an oil substitute.

It has become apparent from technology trends that future transportation methods and combustion methods will utilize finely ground coal, often below 200 mesh. In certain instances where emulsions with oil or water or mixtures thereof are formulated, coal is ground to powders 350–400 mesh and below. While it may be advantageous to finely grind coal to this size to liberate the carbonaceous materials from the inert ash and chemically undesirable compounds as pyrite, such finely ground particles present substantial problems in applying conventional separation procedures.

In conventional systems for cleaning coal, it is customary to remove substantial portions of the pyrites and ash using largely mechanical separation means. Coal is crushed to a uniform size and specific gravity techniques are used to separate the lighter weight carbon and hydrocarbon materials from the heavier pyrite and ash waste materials. One effective method of separation is with a water cyclone. A water cyclone or hydrocyclone is a concentrator for the wet processing, of finely divided materials. The cyclone has no moving parts, and utilizes the principles of centrifugal forces to separate materials of different specific gravity by directing a high velocity slurry at a steep surface of a conical bowl, which provides for an overflow carrying lighter weight materials, and an underflow carrying heavier weight materials. By careful design of the geometry of the surface, materials can be separated at select median specific gravities or cut points. For coal, complex multiple angle surfaces have been devised to provide a full range of selectable cut points adaptable to the variety of different coals. Such compound water cyclones are customerily used in multiples with a recirculating of middling material to improve a clear separation of lights and heavies in desired proportions.

The composition of coal renders the specific gravity separation of constituent materials an imprecise art.

Coal is an amalgamation of different materials which is not consistently amorphous and is not strictly stratified. Liberating particles of the constituent materials by crushing improves the potential ability to separate at desired specific gravities. However, it has been found that there is a limit for grinding using conventional cyclone systems because fine particles in the range of 200 mesh and below tend to naturally agglomerate in the cyclone feedwater system, thereby inhibiting particle differentiation and select separation in the cyclone. While the cause of such balling is not wholly understood, it is believed that the substantial increase in surface area in a mass of extremely fine particles allow exposed hydrophobic hydrocarbons of the carbonaceous material, which have a natural mutual affinity, to cause a coalescence of particles into an agglomerate. While the use of selective surfactants can encourage this agglomeration process and lead to methods for select separation of carbonaceous and non-carbonaceous compositions, such methods are somewhat slower than cycloning yet are recognized as competitive processes.

The method of refining coal here devised solves the problem of undersirable agglomeration and provides additional benefits improving the resultant efficiency of the refining operation and the quality of the refined product.

SUMMARY OF THE INVENTION

The new and improved method for refining coal, particularly coal containing pyritic sulfur, comprises the use of a non-aqueous, floc inhibiting liquid as the carrier medium for a prepared, finely ground ore that is substantially moisture free. The dewatered coal fines are preferably prepared by immersion of the fines in the carrier medium which is maintained at a temperature in excess of the evaporation temperature of the entrained water. The non-aqueous carrier medium with the coal fines is fed through the cyclone in the same manner water was used conventionally. In selecting a non-aqueous, floc inhibiting liquid certain characteristics are preferred. Preferably the liquid should have a greater wetting ability than water, and a lower surface tension to facilitate dispersion and migration of the small, light weight particles under the influence of the centrifugal forces. The liquid preferably comprises a solvent or mixed liquid liquor which can be substantially removed from the separated fines after cycloning such that any combustion inhibiting substances or substances that are toxic or excessively environmentally detrimental on combustion are removed with removal of the solvent or liquor. Preferably the liquid should be selected from a class of organic solvents of which residues in the finished product would enhance rather than retard combustion such as alcohols and petroleum distillates. The carrier medium can be further optimized by selection of a liquid or a mixed liquid liquor that has a particular density most effective for separating the coal being processed. Finally, the ultimately preferred liquid is one that has extractant properties for the non-pyritic forms of sulfur which may be present in the ore. Such solvents are described in my U.S. Pat. No. 4,213,793, issued July 22, 1980, Reissue application No. 266,631, filed 26 May, 1981. These and other features of the devised method for refining coal ores are described in greater detail in the detailed description of the preferred embodiments.

DETAILED DESCRIPTION OF THE PREFERRED EMBODIMENTS

The improved method for refining coal integrates a form of mechanical coal cleaning with a form of chemical cleaning to produce a result that cannot be accomplished with either process alone or in separated sequence.

The improved method allows the coal to be crushed and ground to a fine particle consistency and be mechanically refined using conventional equipment. Coal is crushed to a fine powder approximately 100 mesh or below and dried by immersion in a non-aqueous liquid at a temperature in excess of the vaporization temperature of water, but below the vaporization temperature of the liquid whereby moisture is vaporized from the coal. The grinding and immersion steps may be combined as is known in the art.

Preferably the demoisturizing liquid is the same as the carrier liquid, but such is not required. It may be desired that an optimum cyclone carrier liquid have a specific gravity heavier or lighter than the liquid used in the demoisturizing step.

Once the ore particles are wholly demoisturized the particles are introduced to a compatible carrier medium preferably a non-aqueous liquid miscible with the drying liquid. As noted, for system efficiency the liquid is preferably the same as the demoisturizing liquid and of a character that prevents agglomeration of the carrier coal particles. A preferred mixed liquid liquor is a mixture of kerosene and perchloroethylene which are miscible in all percentages. Both are excellent solvents for extracting elemental sulfur and by select variation of the mixture the specific gravity of the liquor can be adjusted in a range from the lower specific gravity of kerosene, less than 1, to the higher specific gravity of perchloroethylene, 1.6. Therefore, while a compound cyclone may have a cone designed for a specific cut point, variations in this cut point can be induced by using a carrier medium with the specific gravity different than that of water. This allows the user to tailor a cyclone process to the particular ore being refined making available cuts in between the standard fixed cuts provided by the limited number of available replacement cone designs for a particular cyclone.

Generally a cyclone includes liner to inhibit wear. Such liners in the past have been of neoprene or other synthetic durable material. The cyclone liner must not be adversely affected by the non-aqueous carrier medium and preferably must be able to withstand elevated temperatures encountered from a carrier liquid that is the same as the heated demoisturizing liquid. Since most solvent extraction processes have a leaching step in which the solvent is maintained at an optimum elevated temperature, the liner must also be of a substance to withstand this temperature, generally less than 130° C. It may be necessary to substitute the manufacturer's liner with a liner of a more temperature tolerant substance such as Teflon.

Because the violent agitation occurring in the cyclone is beneficial to leaching of sulfur by an extractant solvent, the cyclone should be insulated to reduce a temperature drop in the carrier liquid as it passes through the cyclone such that leaching is not interrupted. Because there is less than a one second dwell time for material passing through the cyclone, steam jacketing the cyclone should not be necessary.

Once the ore particles have been divided by one or more cyclones in a desired circuit, the separate materials may proceed on a defined processing leg, such as a full leaching step as described in the referenced patent.

Alternately, the carrier liquid can be removed from each of the separated materials by conventional means, such as centrifuging and the materials dried to recover the carrier liquid and produce a moisture free product for use or further refining.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A method of cyclone cleaning of fine particle coal containing carbonaceous material, ash and pyrites comprising the steps of:

a. demoisturizing the coal by immersing the coal in a non-aqueous drying liquid having a vaporization temperature higher than that of water, the drying liquid being maintained at a temperature exceeding the vaporization temperature of water, whereby water in the coal is vaporized from the coal and drying liquid;

b. transferring the coal to a non-aqueous, agglomerate inhibiting, carrier liquid miscible with the drying liquid, said carrier liquid is comprised of a liquid mixture of a first liquid having a first specific gravity and a second liquid having a second specific gravity different from said first specific gravity, the carrier liquid's specific gravity is adjusted by using a select amount of each of said first and second liquids to yield a carrier liquid specific gravity intermediate said first and second specific gravities, said carrier liquid specific gravity being greater than 1 less than 1.6 selected for effective separation of carbonaceous material from pyrites and ash for a particular coal and wherein the carrier liquid has the characteristic of extracting non-pyrite forms of sulfur from the coal; and, c. cycloning the coal in the carrier liquid with a compound cyclone, wherein a first stream predominantly consisting of carbonaceous material and liquid is separated from a second stream predominantly consisting of ash, pyrites and liquid.

2. The method of claim 1 wherein said carrier liquid is maintained at an optimized elevated temperature for extracting non-pyritic forms of sulfur from the coal.

3. The method of claim 1 wherein said non-aqueous drying liquid is the same as said carrier liquid.

4. The method of claim 1 wherein said carrier liquid has a specific gravity selected for optimum separation of ash and pyrites from the carbonaceous material in the coal being processed.

5. The method of claim 4 wherein said first liquid is light weight kerosene and said second liquids is heavy weight perchloroethylene in proportions forming a desired specific gravity between the specific gravity of the kerosene and the specific gravity of the perchloroethylene.

6. The method of claim 1 wherein said carrier liquid is a combustion enhancing substance.

7. The method of claim 1 wherein said carrier liquid is removed from said separated carbonaceous material and from said ash and pyrites.

* * * * *